US007781907B2

(12) United States Patent
Aiba

(10) Patent No.: US 7,781,907 B2
(45) Date of Patent: Aug. 24, 2010

(54) IMAGE FORMING APPARATUS, IMAGE READING APPARATUS AND COMPLEX MACHINE

(75) Inventor: Kiyoshi Aiba, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

(21) Appl. No.: 11/874,089

(22) Filed: Oct. 17, 2007

(65) Prior Publication Data

US 2008/0095552 A1 Apr. 24, 2008

(30) Foreign Application Priority Data

Oct. 18, 2006 (JP) ..... 2006-283312

(51) Int. Cl.
*G03G 15/00* (2006.01)

(52) U.S. Cl. ..... 307/25; 307/26

(58) Field of Classification Search ..... 307/25, 307/26, 42, 72, 75

See application file for complete search history.

(56) References Cited

U.S. PATENT DOCUMENTS 4,626,697 A * 12/1986 Nelson ..... 307/18
5,847,948 A * 12/1998 Gatto et al. ..... 363/65
2006/0285161 A1* 12/2006 Otsuka ..... 358/1.18

FOREIGN PATENT DOCUMENTS

JP 2000-270134 9/2000
JP 2003-054097 2/2003

* cited by examiner

*Primary Examiner*—Fritz M Fleming
(74) *Attorney, Agent, or Firm*—Hogan Lovells US LLP

(57) ABSTRACT

An image forming apparatus, includes: a first rectifying circuit that is connected with an external commercial power supply and rectifies an alternating-current input; a first low-voltage power supply circuit that generates low voltages from a rectified power for power supply to respective parts of the apparatus; a first connector that is connected with the first rectifying circuit and is for outputting a power rectified by the first rectifying circuit; and a second connector that is connected with the first low-voltage power supply circuit and is for taking in a rectified power, wherein the apparatus is singly usable and optionally usable by being connected with an image reading apparatus, and the apparatus forms an electrostatic latent image, forms a toner image by developing the electrostatic latent image with toner, and fixes the toner image onto a transfer sheet.

6 Claims, 11 Drawing Sheets

IMAGE FORMING APPARATUS, IMAGE READING APPARATUS AND COMPLEX MACHINE

The disclosure of Japanese Patent Application No. 2006-283312 filed on Oct. 18, 2006 including specification, drawings and claims is incorporated herein by reference in its entirety.

BACKGROUND

1. Technical Field

The invention relates to an image forming apparatus, an image reading apparatus and a complex machine provided with these.

2. Related Art

There have been known complex machines, each of which includes a print function, a copy function and a facsimile function. In a complex machine disclosed in JP-A-2000-270134 for example, a singly usable scanner is added to a singly usable printer later on so as to be usable as a copier or a facsimile machine. On the other hand, such an apparatus including a printer, a scanner, and a complex machine has built-in electrical circuits for obtaining power from an external commercial power supply and supplying the power to respective parts of the apparatus. An apparatus disclosed in JP-A-2003-54097, for example, includes, as the electrical circuits, a rectifying circuit for rectifying an alternating-current input from an external commercial power supply, and a low-voltage power supply circuit such as a DC-DC converter for generating low voltages from the power rectified by the rectifying circuit for the power supply to the respective parts of the apparatus.

By the way, the constructions of the electric circuits need to be sufficiently studied in order to make a printer and a scanner singly usable and also usable as a complex machine by connecting them with each other like those disclosed in JP-A-2000-270134. Specifically, the rectifying circuit is an essential circuit for each, in the case of using each of the printer and the scanner singly for example, whereas one rectifying circuit can be shared in the case of using them as a complex machine by connecting them with each other. In this case, a construction for making the rectifying circuit commonly usable needs to be prepared. Further, if special electric circuits are provided for the single use and for the use as the complex machine in each of the printer and the scanner, labor hour and cost for circuit design increase. Hence, it is preferable that the electric circuits are maximally shared. Furthermore, when one rectifying circuit is shared and power is supplied to the respective parts of the both apparatuses by generating low voltages from the rectified power in the complex machine, power consumption at low voltages increases as a whole. Accordingly, an input current from the external commercial power supply becomes excessive when loads have low power factors. This is not preferable in light of the durability of the parts and power consumption efficiency. However, no consideration is made on these points in the above machine and apparatus disclosed in JP-A-2000-270134 and JP-A-2003-54097.

SUMMARY

An advantage of some aspects of the invention is to provide an image forming apparatus capable of suppressing increases in labor hour and cost for circuit design, the image forming apparatus being singly usable and optionally usable by being connected with an image reading apparatus.

Another advantage of some aspects of the invention is to provide an image reading apparatus capable of suppressing increases in labor hour and cost and preventing an input current from an external commercial power supply from becoming excessive in the case of being used by being connected with an image forming apparatus, the image reading apparatus being singly usable and optionally usable by being connected with an image forming apparatus.

Still another advantage of some aspects of the invention is to provide a complex machine capable of suppressing increases in labor hour and cost and preventing an input current from an external commercial power supply from becoming excessive, the complex machine including an image forming apparatus and an image reading apparatus used by being connected with the image forming apparatus.

According to a first aspect of the invention, there is provided an image forming apparatus, comprising: a first rectifying circuit that is connected with an external commercial power supply and rectifies an alternating-current input; a first low-voltage power supply circuit that generates low voltages from a rectified power for power supply to respective parts of the apparatus; a first connector that is connected with the first rectifying circuit and is for outputting a power rectified by the first rectifying circuit; and a second connector that is connected with the first low-voltage power supply circuit and is for taking in a rectified power, wherein the apparatus is singly usable and optionally usable by being connected with an image reading apparatus, and the apparatus forms an electrostatic latent image, forms a toner image by developing the electrostatic latent image with toner, and fixes the toner image onto a transfer sheet.

According to a second aspect of the invention, there is provided an image reading apparatus, comprising: a single-use circuit board on which a second rectifying circuit and a single-use low-voltage power supply circuit are mounted, the second rectifying circuit being connected with an external commercial power supply and rectifying an alternating-current input, the single-use low-voltage power supply circuit being connected with the second rectifying circuit and generating low voltages for a power supply to respective parts of the apparatus from a power rectified by the second rectifying circuit; a complex-use circuit board on which a power-factor correction circuit and a second low-voltage power supply circuit are mounted, and to which a complex-use connector connected with an input side of the power-factor correction circuit and a power-factor connector connected with an output side of the power-factor correction circuit are attached, the power-factor correction circuit for correcting the power factors of loads, and the second low-voltage power supply circuit being connected with an output side of the power-factor correction circuit and generating low voltages from a rectified power for a power supply to respective parts of the apparatus; and a second board mounting portion on which both the single-use circuit board and the complex-use circuit board are selectively mountable, wherein the apparatus is singly usable and optionally usable by being connected with the image forming apparatus according to the first aspect of the invention, and the apparatus reads an image of a document.

According to a third aspect of the invention, there is provided a complex machine, comprising: an image forming apparatus that forms an electrostatic latent image, forms a toner image by developing the electrostatic latent image with toner, and fixes the toner image onto a transfer sheet; and an image reading apparatus that is used by being connected with the image forming apparatus and reads an image of a document, wherein the image forming apparatus includes: a first rectifying circuit that is connected with an external commercial power supply and rectifies an alternating-current input; a first low-voltage power supply circuit that generates low voltages from a rectified power for a power supply to respective parts of the apparatus; a first connector that is connected with the first rectifying circuit and is for outputting a power rectified by the first rectifying circuit; and a second connector that is connected with the first low-voltage power supply circuit and is for taking in a rectified power, wherein the image reading apparatus includes: a power-factor correction circuit that corrects the power factors of loads; a second low-voltage power supply circuit that is connected with an output side of the power-factor correction circuit and generates low voltages from a rectified power for a power supply to respective parts of the apparatus; a complex-use connector that is connected with an input side of the power-factor correction circuit; and a power-factor connector that is connected with an output side of the power-factor correction circuit, wherein the first connector and the complex-use connector are connected by wiring, and wherein the second connector and the complex-use connector are connected by wiring.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
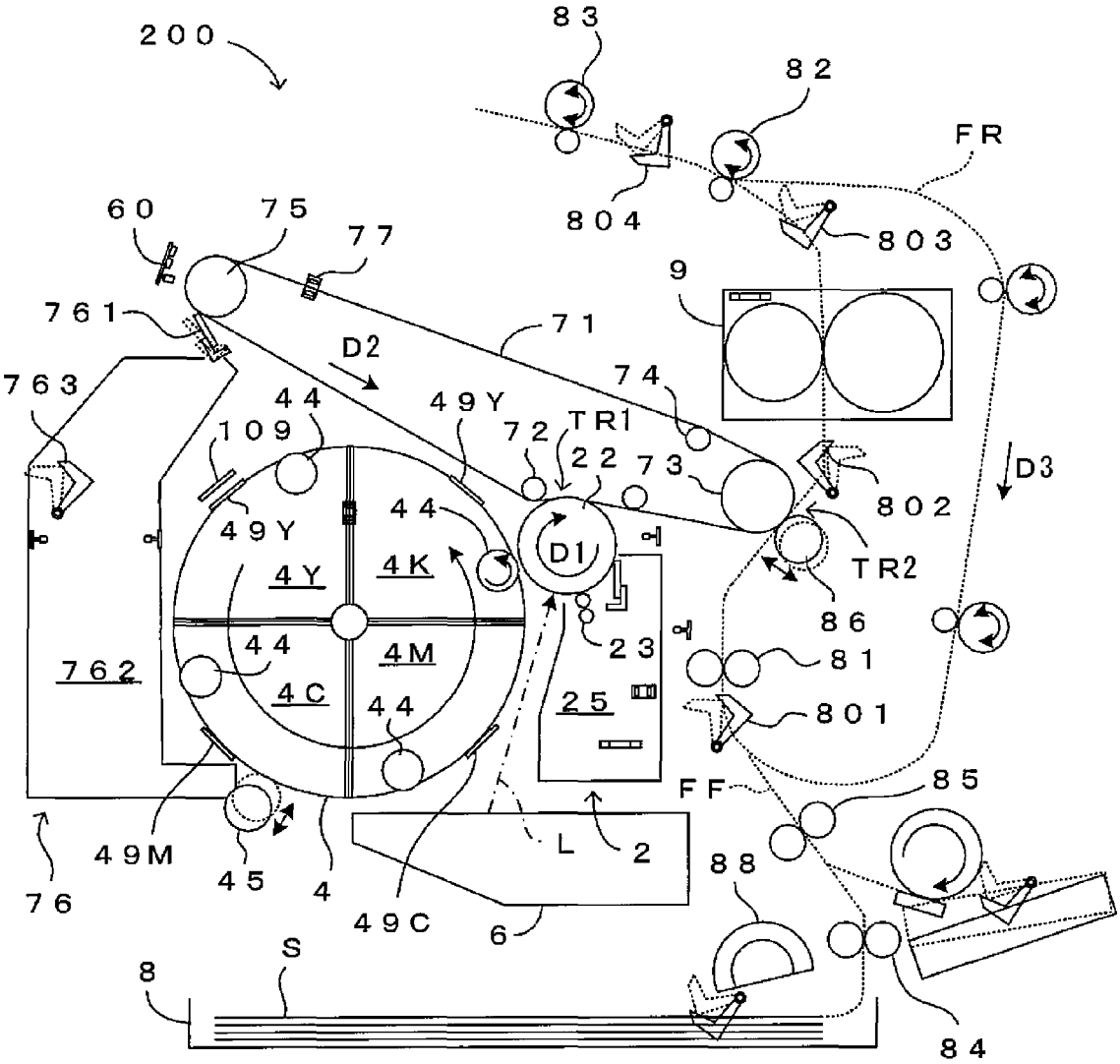
FIG. 1 is a diagram showing an embodiment of an image forming apparatus according to the invention.
Figure 2:
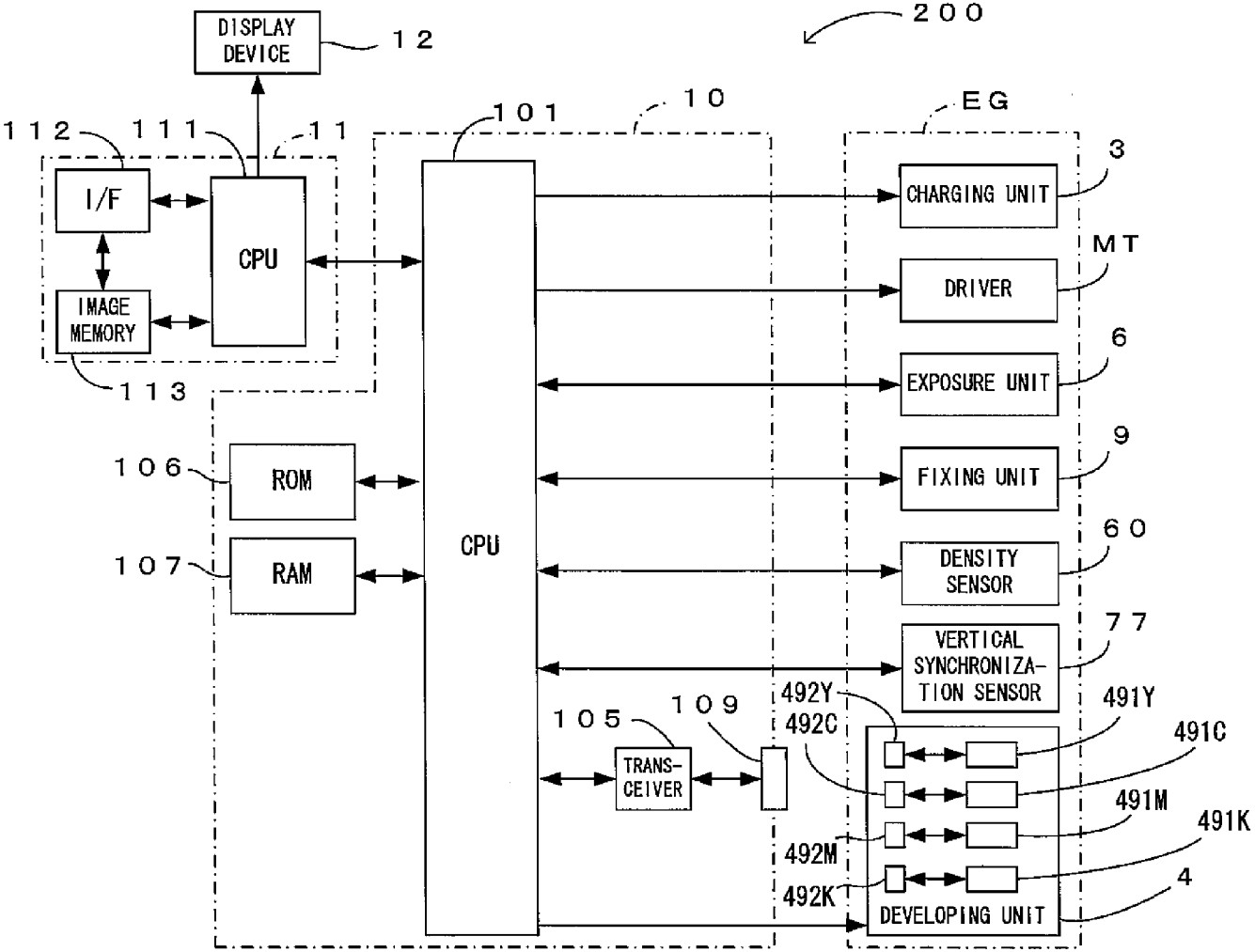
FIG. 2 is a block diagram showing an electrical construction of the image forming apparatus of FIG. 1.

FIG. 1 is a diagram showing an embodiment of an image forming apparatus according to the invention, and FIG. 2 is a block diagram showing an electrical construction of the image forming apparatus of FIG. 1. This apparatus 200 is an image forming apparatus for forming a full color image by superimposing toners (developers) of four colors, that is, yellow (Y), cyan (C), magenta (M) and black (K) and a monochromatic image using only the toner of black (K). In this image forming apparatus 200, when an image signal is fed to a main controller 11 from an external apparatus such as a host computer, a CPU 101 provided in an engine controller 10 controls the respective parts of an engine EG in accordance with a command from this main controller 11 to perform a specified image forming operation, whereby an image corresponding to the image signal is formed on a sheet S. In other words, this image forming apparatus 200 operates as a printer when being singly used. The image forming apparatus (hereinafter called "printer") 200 can operate as a complex machine 400 having a copy function by being connected with a scanner 300 having an image reading function as shown in FIG. 4 to be described later.

In this engine EG, a photosensitive member 22 is disposed rotatably in a direction of an arrow D1 in FIG. 1. A charging roller 23 of a charging unit 3, a rotary developing unit 4 and a cleaning device 25 are arranged along the rotating direction D1 around the photosensitive member 22. A specified charging bias is applied to the charging roller 23, which charges the outer circumferential surface of the photosensitive member 22 to a specified surface potential. The cleaning device 25 removes the toner residual on the outer surface of the photosensitive member 22 after primary transfer and collects it into a waste toner tank provided inside. The photosensitive member 22, the charging roller 23 and the cleaning device 25 integrally construct a photosensitive member cartridge 2, which is attachable to and detachable from an apparatus main body as a unit.

The outer circumferential surface of the photosensitive member 22 charged by the charging unit 3 is irradiated with a light beam L from an exposure unit 6. This exposure unit 6 forms an electrostatic latent image corresponding to an image signal fed from the external apparatus by irradiating the light beam L to the photosensitive member 22 for exposure in accordance with the image signal.

The electrostatic latent image thus formed is developed with toner by the developing unit 4. Specifically, in this apparatus, the developing unit 4 includes a support frame 40 disposed rotatably about a rotation axis normal to the plane of FIG. 1, and a yellow developing device 4Y, a cyan developing device 4C, a magenta developing device 4M and a black developing device 4K, which are formed as cartridges attachable to and detachable from the support frame 40 and respectively contain nonmagnetic one-component toners of the corresponding colors. This developing unit 4 is driven to rotate by a stepping motor, for instance, of a driver MT controlled by the engine controller 10. Further, a rotary lock 45 which abuts on and moves away from the developing unit 4 is disposed in the apparatus main body. This rotary lock 45 acts as a braking and locking mechanism for restraining the rotation of the developing unit 4 and stopping the developing unit 4 at a specified position by being brought into contact with the outer circumferential portion of the support frame 40 of the developing unit 4 when needed.

When the developing unit 4 is driven to rotate and the developing devices 4Y, 4C, 4M and 4K are selectively brought to a specified position facing the photosensitive member 22 in accordance with a control command from the engine controller 10, a developing roller 44 disposed in the positioned developing device and carrying the toner of the selected color is arranged to face the photosensitive member 22 at a specified gap thereto and the toner is given to the outer surface of the photosensitive member 22 from the developing roller 44 at this facing position. In this way, the electrostatic latent image on the photosensitive member 22 is developed with the toner of the selected color.

The toner image developed by the developing unit 4 in the above manner is primarily transferred onto an intermediate transfer belt 71 of a transfer unit 7 in a primary transfer region TR1. The transfer unit 7 includes the intermediate transfer belt 71 mounted on a plurality of rollers 72 to 75, and the intermediate transfer belt 71 is turned in a specified rotating direction D2 by driving the roller 73 to rotate by means of a stepping motor, for instance, of the driver MT. In the case of transferring a color image to the sheet S, the toner images of the respective colors formed on the photosensitive member 22 are superimposed on the intermediate transfer belt 71 to form a color image, and the color image is secondarily transferred onto the sheet S fed from a cassette 8 and conveyed to a secondary transfer region T12 along a conveyance path FF.

The secondary transfer region TR2 is a nip portion where the outer surface of the intermediate transfer belt 71 mounted on the roller 73 and a secondary transfer roller 86 which abuts on and moves away from the outer surface thereof are in contact. Sheets S stacked in the cassette 8 are dispensed one by one by the rotation of a pickup roller 88 to be brought to the conveyance path FF, and then conveyed to the secondary transfer region TR2 along the conveyance path FF by the rotation of feed rollers 84 and 85 and gate rollers 81.

At this time, a timing at which the sheet S is fed to the secondary transfer region TR2 is administered in order to precisely transfer the image on the intermediate transfer belt 71 to a specified position on the sheet S. Specifically, this timing is administered as follows. The gate rollers 81 are disposed before the secondary transfer region TR2 on the conveyance path FF and a before-gate sheet detection sensor 801 is disposed before the gate rollers 81. The conveyance of the sheet S is temporarily stopped when the arrival of the sheet S conveyed along the conveyance path FF is detected by the before-gate sheet detection sensor 801, and the sheet S is fed to the secondary transfer region TR2 at a specified timing by resuming the rotation of the gate rollers 81 in synchronization with a turning timing of the intermediate transfer belt 71. In this way, the toner image formed on the intermediate transfer belt 71 is secondarily transferred to the front side of the sheet S passing through the secondary transfer region TR2.

The sheet S having the color image thus formed thereon has the toner image fixed by a fixing unit 9 and is conveyed to a discharge tray (not shown) provided at the upper surface of the apparatus main body by way of a pre-discharge roller 82 and a discharge roller 83. In the case of forming images on both sides of the sheet S, the rotation of the discharge roller 83 is reversed when the trailing end of the sheet S having the image formed on one side thereof as described above is conveyed to a reversing position located behind the pre-discharge roller 82, whereby the sheet S is conveyed in a direction of an arrow D3 along a reversing conveyance path FR. The sheet S enters the conveyance path FF again before the gate rollers 81. At this time, the side of the sheet S which comes into contact with the intermediate transfer belt 71 in the secondary transfer region TR2 to have an image transferred thereto is the side opposite to the one onto which the image was previously transferred. In this way, images can be formed on both sides of the sheet S.

In addition to the before-gate sheet detection sensor 801, sheet detection sensors 802 to 804 for detecting the presence or absence of the sheet passing on the conveyance path are disposed at positions of the sheet conveyance path FF and the reversing conveyance path FR, and sheet conveyance timings are administered and jam detection is made at the respective positions based on outputs of these sensors.

A cleaner 76 is arranged in the vicinity of the roller 75. This cleaner 76 includes a cleaner blade 761 movable toward and away from the roller 75 by an unillustrated electromagnetic clutch, and a waste toner tank 762. After being moved toward the roller 75, the cleaner blade 761 is in contact with the outer surface of the intermediate transfer belt 71 mounted on the roller 75, thereby scraping off and removing the toner residual on the outer circumferential surface of the intermediate transfer belt 71 after the secondary transfer. The scraped off toner is stored in the waste toner tank 762. A waste toner sensor 763 for detecting a full state of this tank is disposed in the waste toner tank 762.

This cleaner blade 761 has its approaching and retracting movements so controlled as to remove the toner residual on the intermediate transfer belt 71 during the same turning movement when the image is transferred to the sheet S in the secondary transfer region TR2. Accordingly, when the apparatus continuously forms monochromatic images for example, an image transferred to the intermediate transfer belt 71 in the primary transfer region TR1 is immediately transferred to a sheet S in the secondary transfer region TR2. Thus, the cleaner blade 761 is kept in contact. On the other hand, in the case of forming a color image, the cleaner blade 761 needs to be separated from the intermediate transfer belt 71 while toner images of the respective colors are superimposed one on another. In the same turning movement during which a full color image is completed by superimposing the toner images of the respective colors one on another and secondarily transferred to a sheet S, the cleaner blade 761 is brought into contact with the intermediate transfer belt 71 to remove the residual toner.

Further, a density sensor 60 and a vertical synchronization sensor 77 are arranged in the vicinity of the roller 75. This density sensor 60 is arranged to face the outer surface of the intermediate transfer belt 71 and measures an image density of a toner image formed on the outer circumferential surface of the intermediate transfer belt 71 when needed. Based on this measurement result, operation conditions of the respective parts of the apparatus that influence the image quality such as development biases given to the respective developing devices and the intensity of the light beam L are adjusted in this apparatus. This density sensor 60 is constructed to output a signal corresponding to an image density of a region of a specified area on the intermediate transfer belt 71 using a reflection-type photosensor for example. The CPU 101 can detect image densities of the respective parts of the toner image on the intermediate transfer belt 71 by regularly sampling output signals from this density sensor 60 while turning the intermediate transfer belt 71.

The vertical synchronization sensor 77 is a sensor for detecting a reference position of the intermediate transfer belt 71 and functions as a sensor for obtaining a synchronization signal outputted in connection with the rotation of the intermediate transfer belt 71, that is, a vertical synchronization signal Vsync. In this apparatus, the operations of the respective parts of the apparatus are controlled in accordance with this vertical synchronization signal Vsync in order to time the operations of the respective parts and precisely superimpose the toner images formed in the respective colors.

Memory tags 49Y, 49C, 49M and 49K are respectively attached to the outer circumferential surfaces of the respective developing devices 4Y, 4C, 4M and 4K constituting the side surface of the developing unit 4 having a substantially cylindrical shape as a whole. For example, the memory tag 49Y attached to the yellow developing device 4Y includes a memory 491Y for storing data on the production lot and usage history of this developing device, the remaining amount of the toner contained inside and the like, and a loop antenna 492Y electrically connected with this memory. The memory tags 49C, 49M and 49K attached to the other developing devices also include memory chips 491C, 491M and 491K and loop antennas 492C, 492M and 492K, respectively.

On the other hand, a wireless communication antenna 109 is provided in the apparatus main body. This wireless communication antenna 109 is driven by a transceiver 105 connected to the CPU 101 and conducts a wireless communication with the wireless communication antennas of the developing devices to transfer data between the CPU 101 and the memories provided in the developing devices, whereby various pieces of information such as articles of consumption concerning the developing devices are managed.

This apparatus also includes a display device 12 controlled by a CPU 111 of the main controller 11 as shown in FIG. 2. This display device 12 includes, for example, a liquid crystal display and displays specified messages to notify operation guides, the progress state of the image forming operation, the occurrence of an abnormality in the apparatus, an exchange timing of any one of the units, etc. to a user in accordance with control commands from the CPU 111.

In FIG. 2, an image memory 113 provided in the main controller 11 is for storing image data fed from the external apparatus such as the host computer via an interface 112. As described later, when a scanner 300 is connected, the image memory 113 stores an image fed from the scanner 300 via the interface 112. Further, a ROM 106 is for storing an operation program executed by the CPU 101 and control data used to control the engine EG, and a RAM 107 is for temporarily storing calculation results in the CPU 101 and other data.

Figure 3:
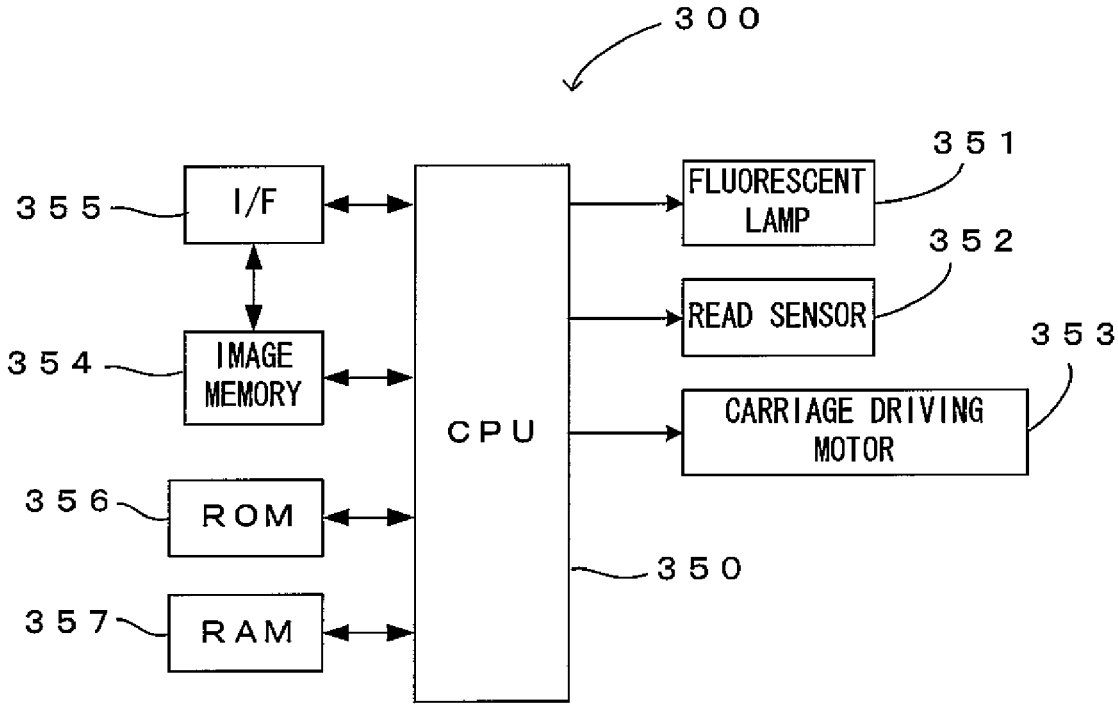
FIG. 3 is a block diagram showing an electrical construction of the scanner 300 as an embodiment of an image reading apparatus according to the invention.

FIG. 3 is a block diagram showing an electrical construction of the scanner 300 as an embodiment of an image reading apparatus according to the invention. A CPU 350 controls the operation of the entire scanner 300. A fluorescent lamp 351 irradiates light to a document, from which an image is to be read. A read sensor 352 is a line sensor in which a plurality of light receiving elements are arrayed in a row for example, receives the reflected light from the document, and outputs an image signal corresponding to an amount of the received light. A carriage drive motor 353 drives a carriage (not shown) supporting the fluorescent lamp 351 and the read sensor 352. By driving the carriage, the fluorescent lamp 351 can irradiate light to the entire surface of the document and the read sensor 352 can receive the reflected light from the entire surface of the document. An image memory 354 stores an image signal outputted from the read sensor 352 as an image data, and can output the stored image data to the outside via an interface 355. A ROM 356 is for storing a control program executed by the CPU 350 and the like, and a RAM 357 is for temporarily storing calculation results in the CPU 350 and other data.

Figure 4A:
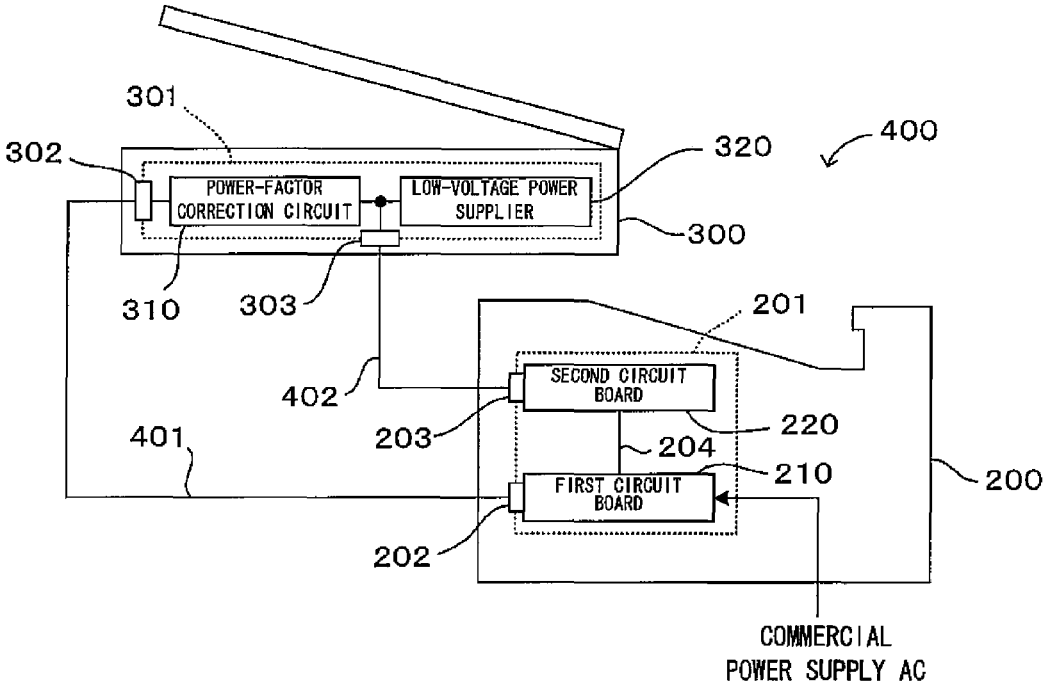
FIG. 4A is a diagram schematically showing an embodiment of a complex machine according to the invention.
Figure 4B:
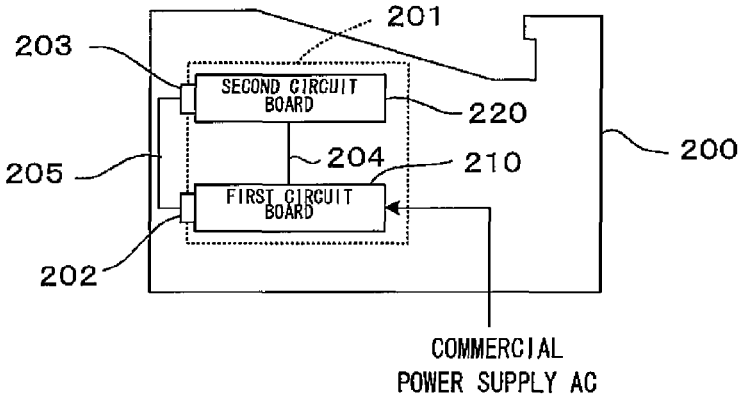
FIG. 4B is a diagram schematically showing a mode in which a printer is singly used.
Figure 4C:
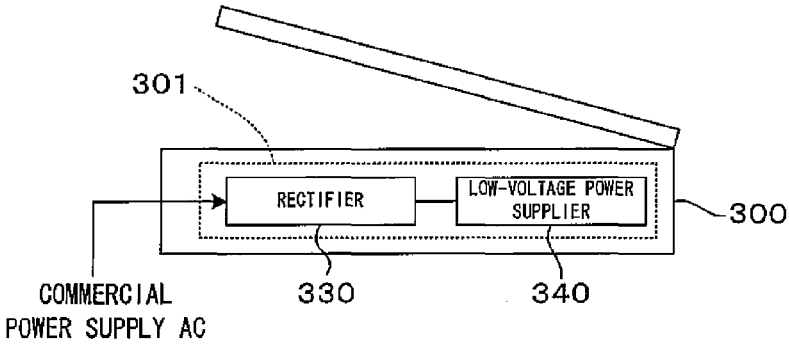
FIG. 4C is a diagram schematically showing a mode in which a scanner is singly used.
Figure 5A:
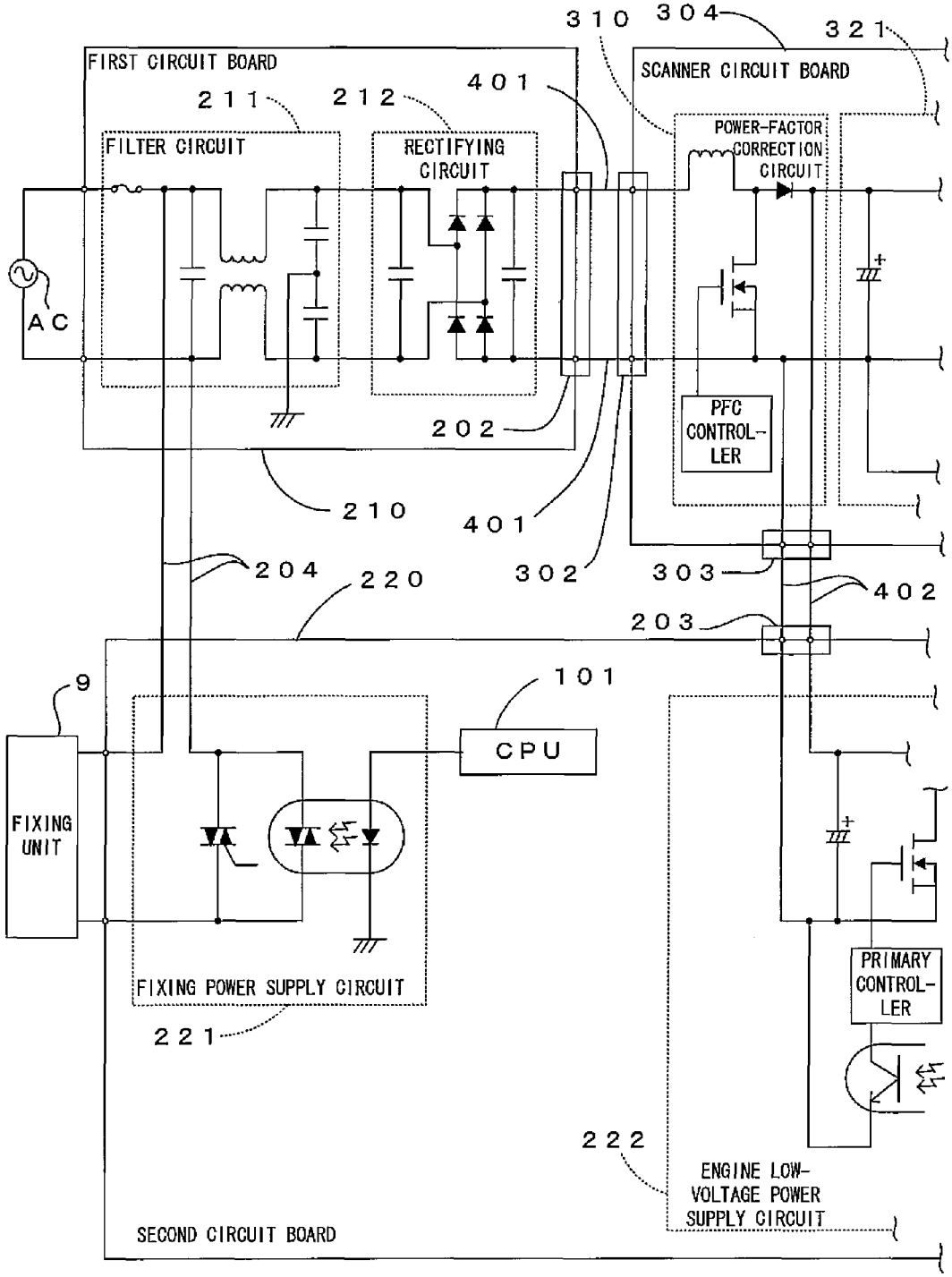
FIGS. 5A and 5B are circuit diagrams showing electric circuits of the complex machine of FIG. 4A.
Figure 5B:
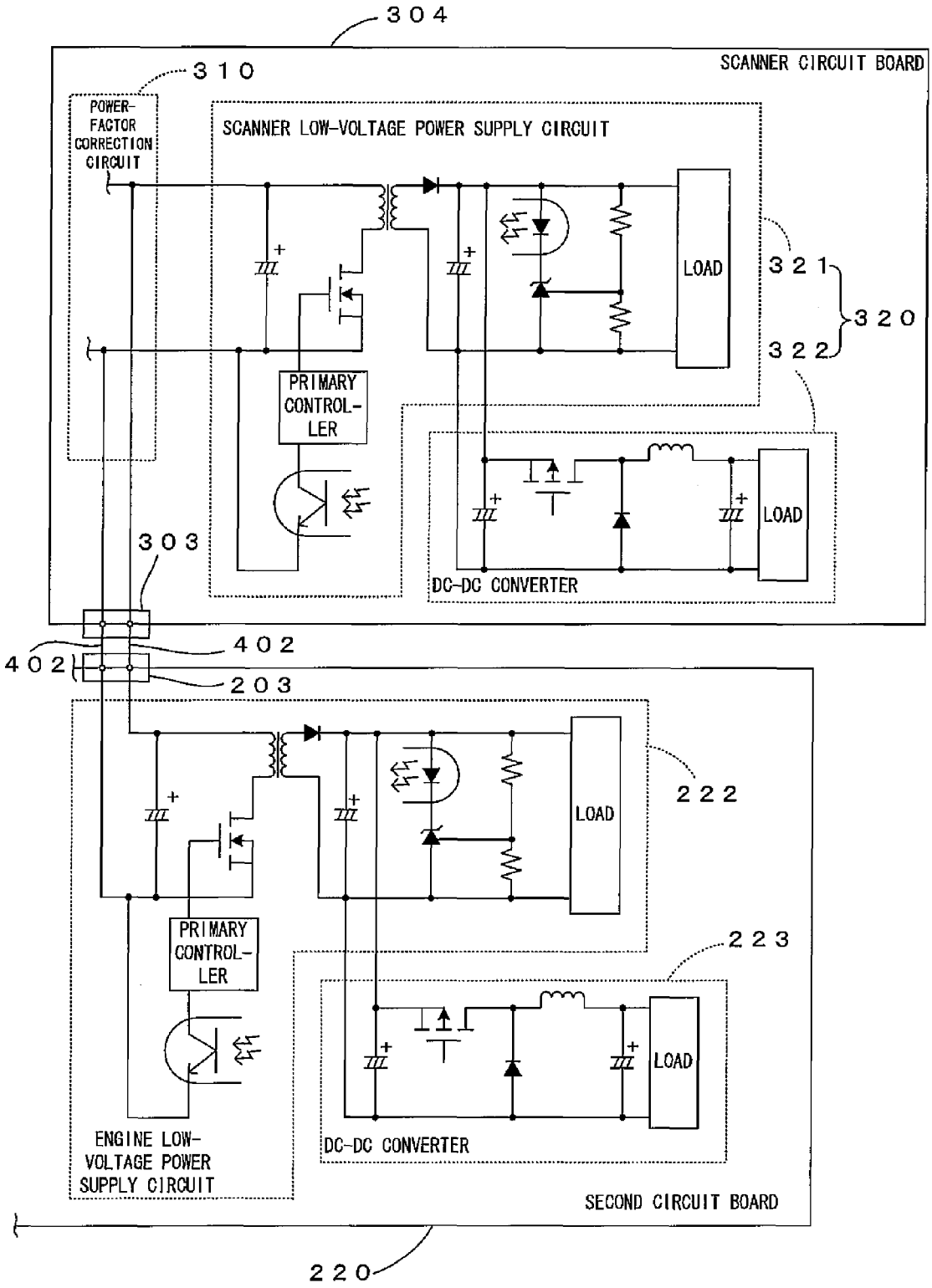
Figure 6A:
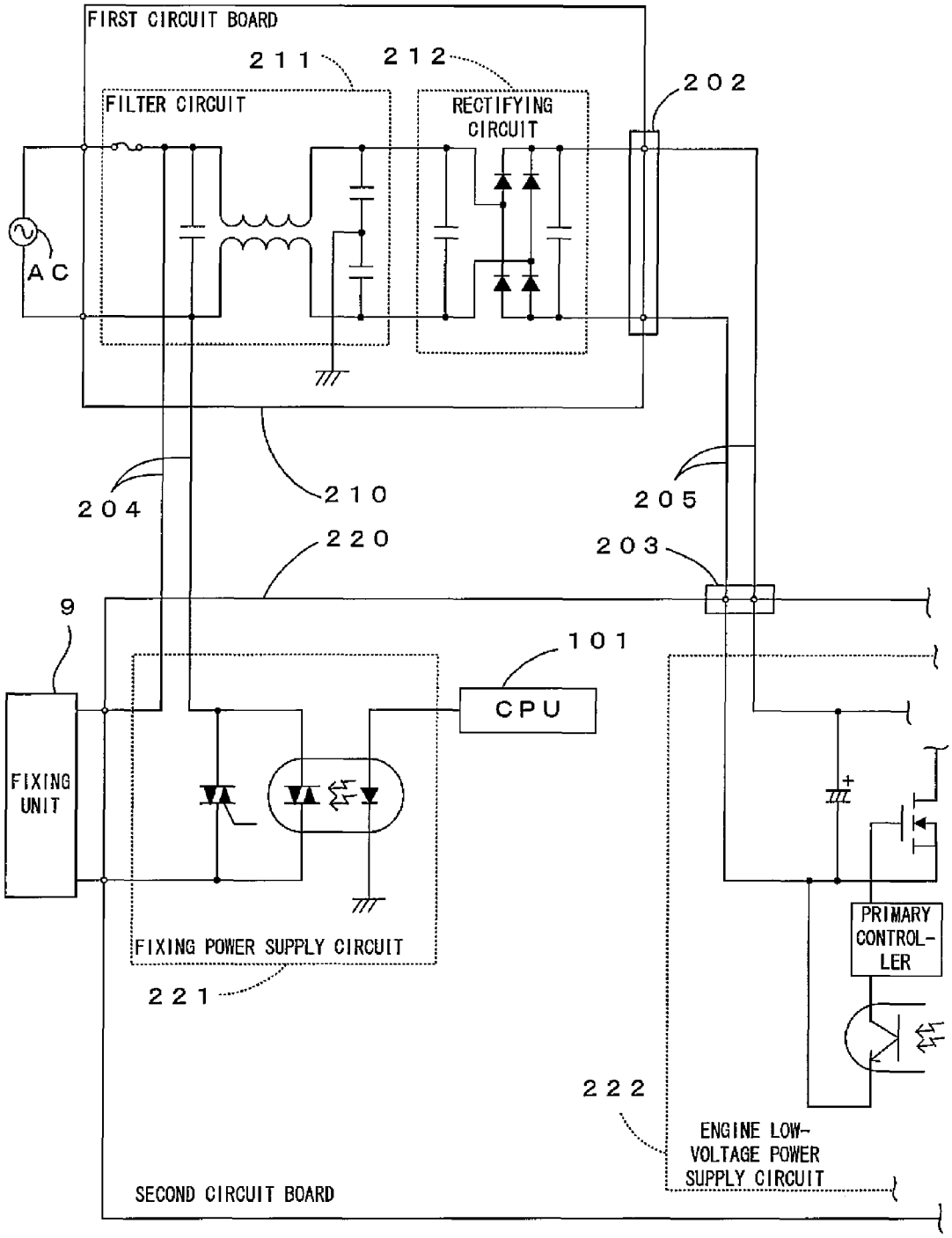
FIGS. 6A and 6B are circuit diagrams showing electric circuits of the printer of FIG. 4B.
Figure 6B:
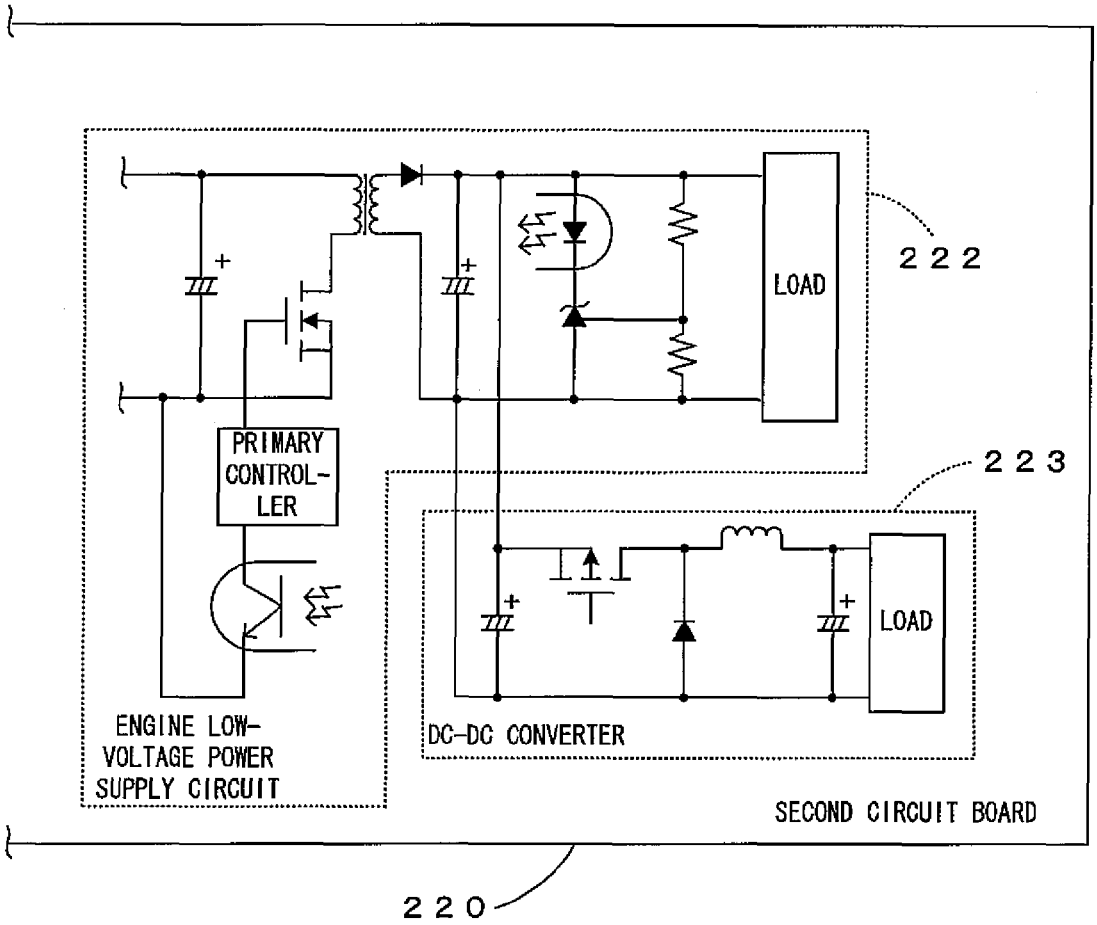
Figure 7A:
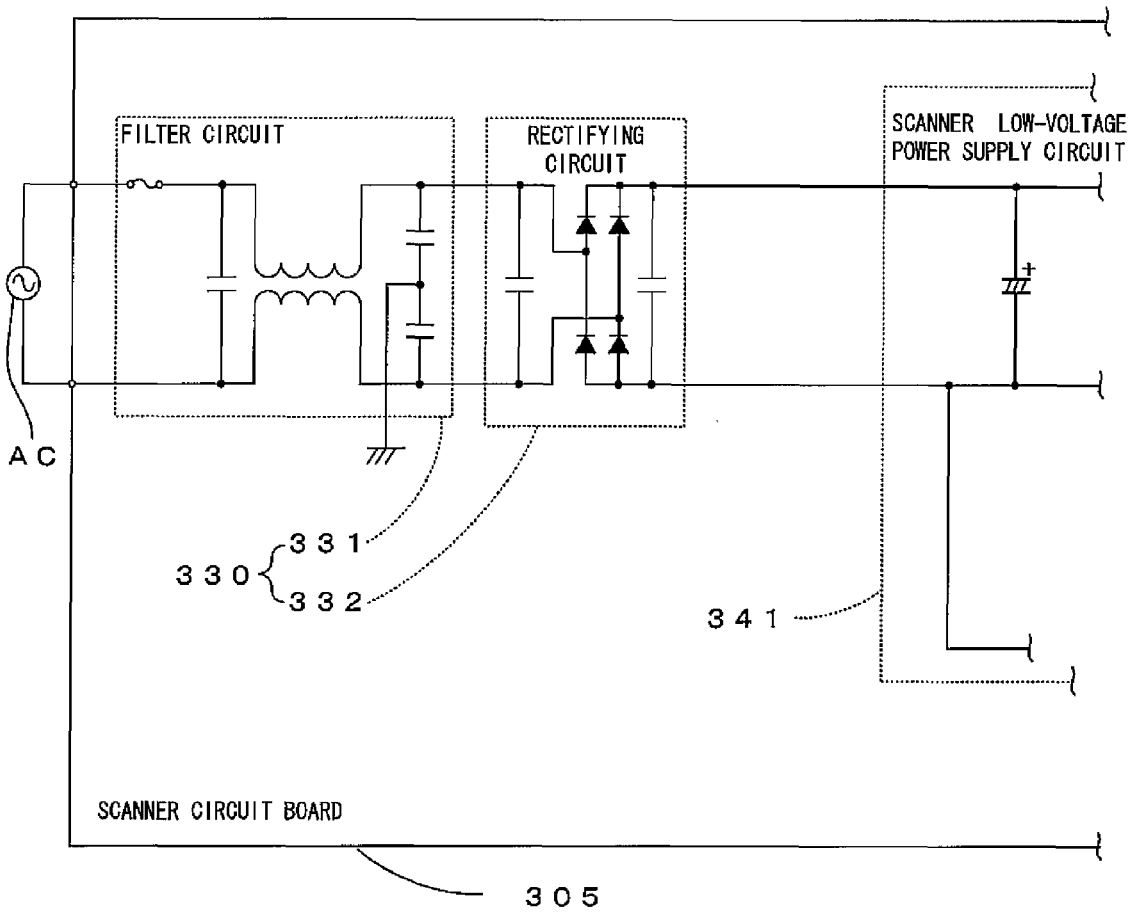
FIGS. 7A and 7B are circuit diagrams showing electric circuits of the scanner of FIG. 4C.
Figure 7B:
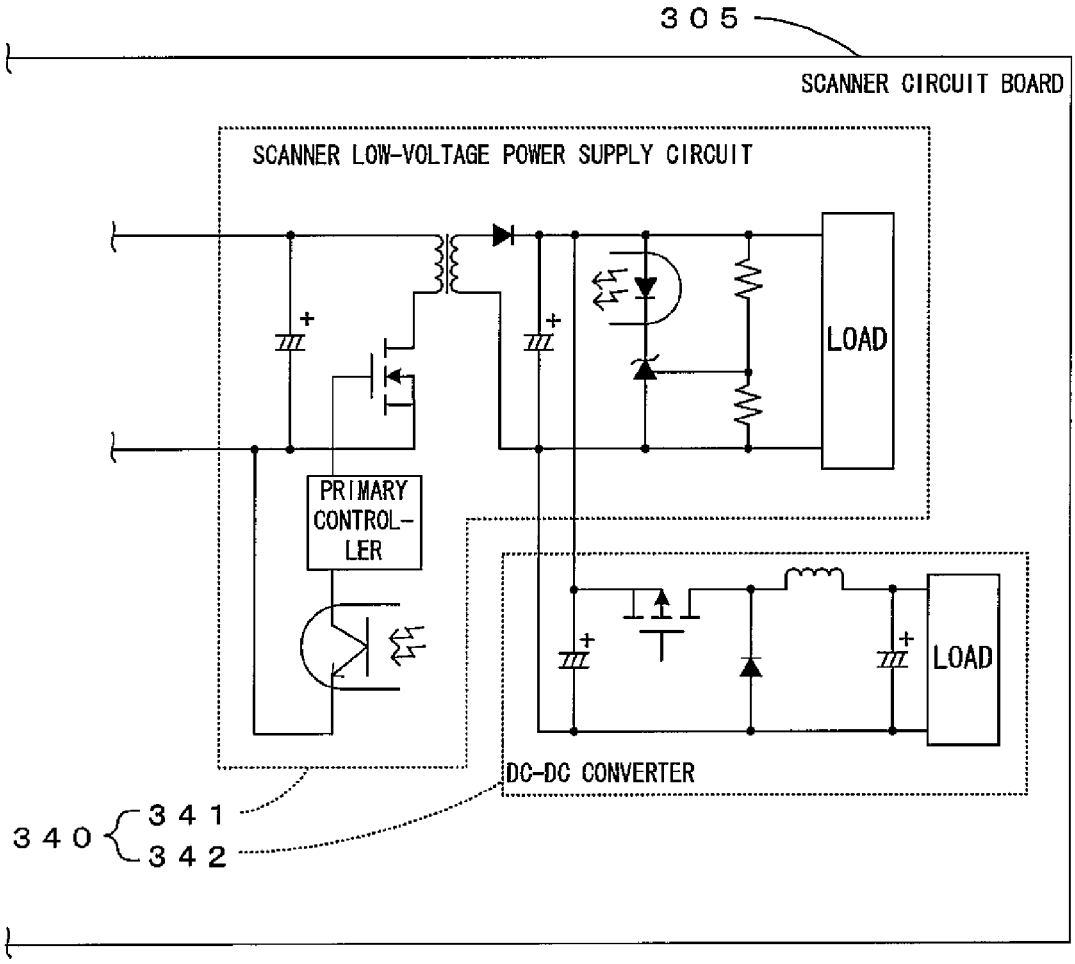

FIG. 4A is a diagram schematically showing an embodiment of a complex machine according to the invention, FIG. 4B is a diagram schematically showing a mode in which the printer 200 is singly used, and FIG. 4C is a diagram schematically showing a mode in which the scanner 300 is singly used. As shown in FIGS. 4A to 4C, the printer 200 and the scanner 300 are both singly usable and usable as a complex machine 400 by being connected with each other. FIGS. 5A and 5B are circuit diagrams showing electric circuits of the complex machine 400 of FIG. 4A. FIGS. 6A and 6B are circuit diagrams showing electric circuits of the printer 200 of FIG. 4B. Further, FIGS. 7A and 7B are circuit diagrams showing electric circuits of the scanner 300 of FIG. 4C. Individual specific circuit constructions in FIGS. 5A, 5B, 6A, 6B, 7A and 7B are not described in detail since being known.

First, with reference to FIGS. 4A, 5A and 5B, the mode of using the printer 200 and the scanner 300 as the complex machine 400 by connecting them is described. In the complex machine 400, a document is read in the scanner 300 and an image data of the document stored in the image memory 354 is fed to the printer 200 via the interface 355 and stored in the image memory 113 of the main controller 11 of the printer 200. Then, the CPU 101 provided in the engine controller 10 controls the respective parts of the engine EG to perform the above image forming operation in accordance with a command from the main controller 11, whereby an image corresponding to an image signal is formed on a sheet S to copy the document read by the scanner 300.

This printer 200 includes a board mounting portion 201, on which a first circuit board 210 and a second circuit board 220 are mounted. A filter circuit 211 and a rectifying circuit 212 are mounted on and a connector 202 is attached to the first circuit board 210. A fixing power supply circuit 221, an engine low-voltage power supply circuit 222 and a DC-DC converter 223 are mounted on and a connector 203 is attached to the second circuit board 220. The fixing power supply circuit 221 of the second circuit board 220 is connected with an input side of the filter circuit 211 of the first circuit board 210 by wiring 204.

The scanner 300 includes a board mounting portion 301, on which a scanner circuit board 304 is mounted. A power-factor correction circuit 310, and a low-voltage power supplier 320 comprised of a scanner low-voltage power supply circuit 321 and a DC-DC converter 322 are mounted on this scanner circuit board 304. A connector 302 connected to an input side of the power-factor correction circuit 310 and a connector 303 connected to an output side of the power-factor correction circuit 310 are attached to this scanner circuit board 304.

The connectors 202 and 302 are connected by wiring 401 and the connector 203 and the connector 303 are connected by wiring 402, whereby the printer 200 and the scanner 300 are electrically connected.

In the printer 200, the filter circuit 211 prevents a high-frequency noise and the rectifying circuit 212 rectifies an alternating-current input from a commercial power supply AC. Further, the fixing power supply circuit 221 supplies an alternating-current power of AC 100V, for example, to the fixing unit 9, and is on-off controlled by the CPU 101. The engine low-voltage power supply circuit 222 generates a low voltage of DC 24V, for example, from the power rectified by the rectifying circuit 212 and supplies the power to loads such as the driver MT. The DC-DC converter 223 generates an even lower voltage, DC 5V for instance, from the output of the engine low-voltage power supply circuit 222 and supplies the power to the loads such as the CPU 101 and the density sensor 60.

In the scanner 300, the power-factor correction circuit 310 corrects the power factors of the loads. An input side of the scanner low-voltage power supply circuit 321 is connected with the rectifying circuit 212 via the power-factor correction circuit 310, the connector 302, the wiring 401 and the connector 202. This scanner low-voltage power supply circuit 321 generates a low voltage of DC 24V for instance from the power rectified by the rectifying circuit 212, and supplies the power to loads such as the fluorescent lamp 351 and the carriage driving motor 353. The DC-DC converter 322 generates an even lower voltage, DC 5V for instance, from the output of the scanner low-voltage power supply circuit 321 and supplies the power to loads such as the CPU 350 and the read sensor 352.

As described above, in this embodiment, the rectifying circuit 212 corresponds to a "first rectifying circuit" of the invention; the engine low-voltage power supply circuit 222 to a "first low-voltage power supply circuit" of the invention; the connector 202 to a "first connector" of the invention; the connector 203 to a "second connector" of the invention; and the board mounting portion 201 to a "first board mounting portion". Further, the scanner low-voltage power supply circuit 321 corresponds to a "second low-voltage power supply circuit" of the invention; the connector 302 to a "complex-use connector" of the invention; the connector 303 to a "power-factor connector" of the invention; and the scanner circuit board 304 to a "complex-use circuit board" of the invention.

Next, with reference to FIGS. 4B, 6A and 6B, the mode of singly using the printer 200 is described. This printer 200 singly used and the printer 200 constructing the above complex machine 400 differ only in that the connector 202 and the connector 203 are directly connected by wiring 205. Specifically, exactly the same first and second circuit boards 210 and 220 as those of the printer 200 constructing the above complex machine 400 are mounted on the circuit mounting portion 201 of the printer 200. Thus, in this embodiment, the rectifying circuit 212 corresponds to the "first rectifying circuit" of the invention; the connector 202 to the "first connector" of the invention; the connector 203 to the "second connector" of the invention; and the board mounting portion 201 to the "first board mounting portion" of the invention.

Next, with reference to FIGS. 4C, 7A and 7B, the mode of singly using the scanner 300 is described. A scanner circuit board 305 is mounted on the board mounting portion 301 of this scanner 300 singly used in place of the above scanner circuit board 304. In other words, both scanner circuit boards 304 and 305 are selectively mountable on the board mounting portion 301 of the scanner 300.

A rectifier 330 comprised of a filter circuit 331 and a rectifying circuit 332, and a low-voltage power supplier 340 comprised of a scanner low-voltage power supply circuit 341 and a DC-DC converter 342 are mounted on this scanner circuit board 305. The filter circuit 331 and the rectifying circuit 332 of the rectifier 330 are respectively constructed similar to the filter circuit 211 and the rectifying circuit 212 of the first circuit board 210 of the printer 200. Further, the scanner low-voltage power supply circuit 341 and the DC-DC converter 342 of the low-voltage power supplier 340 are respectively constructed similar to the scanner low-voltage power supply circuit 321 and the DC-DC converter 322 of the low-voltage power supplier 320 on the scanner circuit board 304.

Thus, in this embodiment, the rectifying circuit 332 corresponds to a "second rectifying circuit" of the invention; the scanner low-voltage power supply circuit 341 to a "single-use low-voltage power supply circuit" of the invention; the scanner circuit board 305 to a "single-use circuit board" of the invention; and the board mounting portion 301 to a "second board mounting portion" of the invention.

As described above, in this embodiment, the first circuit board 210 having the rectifying circuit 212 mounted thereon and the second circuit board 220 having the engine low-voltage power supply circuit 222 mounted thereon and different from the first circuit board 210 are mounted on the board mounting portion 201 of the printer 200. The connector 202 connected with the output side of the rectifying circuit 212 is attached to the first circuit board 210, and the connector 203 connected with the input side of the engine low-voltage power supply circuit 222 is attached to the second circuit board 220. Accordingly, with exactly the same circuit boards 210 and 220 mounted, both the single use of the printer 200 and the use thereof as the complex machine 400 by being connected with the scanner 300 can be coped with only by changing the connection ends of the connectors 202 and 203. Therefore, the electric circuits can be shared regardless of a difference in the use mode and increases in labor hour and cost for circuit design can be suppressed.

Further, according to this embodiment, both the scanner circuit boards 304 and 305 are selectively mountable on the board mounting portion 301 of the scanner 300. Thus, only by exchanging the circuit board to be mounted on the board mounting portion 301, the case of singly using the scanner 300 and the case of connecting the scanner 300 with the printer 200 to use as the complex machine 400 can be respectively easily coped with and increases in labor hour and cost for circuit design can be suppressed.

Since the connector 302 attached to the scanner circuit board 304 and connected to upstream of the power-factor correction circuit 310 and the connector 202 attached to the first circuit board 210 of the printer 200 and connected to downstream of the rectifying circuit 212 are connected by the wiring 401 at the time of the use as the complex machine 400, the rectifying circuit 212 can be shared by the engine low-voltage power supply circuit 222 and the scanner low-voltage power supply circuit 321. Therefore, cost can be decreased by reducing the number of parts and simplifying the circuit construction.

At the time of the use as the complex machine 400, the power-factor correction circuit 310 is mounted on the scanner circuit board 304 to be mounted on the board mounting portion 301. Since the connector 303 connected to downstream of the power-factor correction circuit 310 and the connector 203 connected to upstream of the engine low-voltage power supply circuit 222 are connected by the wiring 402, both the engine low-voltage power supply circuit 222 and the scanner low-voltage power supply circuit 321 are arranged downstream of the power-factor correction circuit 310. Accordingly, the sum of the loads of the printer 200 to which power is supplied from the engine low-voltage power supply circuit 222 directly or via the DC-DC converter 223 and the loads of the scanner 300 to which power is supplied from the scanner low-voltage power supply circuit 321 directly or via the DC-DC converter 322 increases, leading to an increase in the power consumption. However, since the power factors of the loads are corrected by the power-factor correction circuit 310, an input current from the commercial power supply AC can be prevented from becoming excessive.

The image forming apparatus according to the embodiment is, in other words, singly usable and optionally usable by being connected with the image reading apparatus, and forms an electrostatic latent image, forms a toner image by developing the electrostatic latent image with toner, and fixes the toner image onto a transfer sheet. Further, the image forming apparatus according to the embodiment comprises: a first rectifying circuit that is connected with an external commercial power supply and rectifies an alternating-current input; a first low-voltage power supply circuit that generates low voltages from a rectified power for power supply to respective parts of the apparatus; a first connector that is connected with the first rectifying circuit and is for outputting a power rectified by the first rectifying circuit; and a second connector that is connected with the first low-voltage power supply circuit and is for taking in a rectified power.

According to the embodiment thus constructed, the alternating-current input from the external commercial power supply is rectified by the first rectifying circuit and can be outputted via the first connector. Further, when a rectified power is taken in via the second connector, low voltages for supplying to respective parts of the apparatus are generated from the rectified power by the first low-voltage power supply circuit. Accordingly, the apparatus can be suitably singly used only by connecting the first connector and the second connector by wiring. On the other hand, in the case where the apparatus is used by being connected with an image reading apparatus, the image reading apparatus can utilize the power rectified by the first rectifying circuit only by connecting the image reading apparatus and the first connector by wiring. Thus, the first rectifying circuit can be easily shared. Further, since the constructions of electric circuits do not change depending on the case where the apparatus is singly used and the case where the apparatus is used by being connected with the image reading apparatus, there is an advantage of not increasing labor hour and cost for circuit design.

Further, the image forming apparatus of the above embodiment comprises a first circuit board on which the first rectifying circuit is mounted and to which the first connector is attached, a second circuit board on which the first low-voltage power supply circuit is mounted, to which the second connector is attached, and which is different from the first circuit board, and a first board mounting portion for mounting the first circuit board and the second circuit board.

According to the embodiment thus constructed, the first circuit board and the second circuit board are mounted on the first board mounting portion. Therefore, in the case where the apparatus is used by being connected with the image reading apparatus, when it is necessary to use the first rectifying circuit having larger capacity than in the case where the apparatus is singly used, it is only necessary to replace the first circuit board. Hence, it is possible to cope flexibly with the needed capacity. Further, since the second circuit board can be commonly utilized in both cases, it is possible to suppress the increase of labor hour and cost for circuit design to a maximum extent.

Further, the image reading apparatus according to the embodiment is, in other words, singly usable and optionally usable by being connected with the image forming apparatus, and reads an image of a document. Further, the embodiment comprises: a single-use circuit board on which a second rectifying circuit and a single-use low-voltage power supply circuit are mounted, the second rectifying circuit being connected with an external commercial power supply and rectifying an alternating-current input, the single-use low-voltage power supply circuit being connected with the second rectifying circuit and generating low voltages for a power supply to respective parts of the apparatus from a power rectified by the second rectifying circuit; a complex-use circuit board on which a power-factor correction circuit and a second low-voltage power supply circuit are mounted, and to which a complex-use connector connected with an input side of the power-factor correction circuit and a power-factor connector connected with an output side of the power-factor correction circuit are attached, the power-factor correction circuit for correcting the power factors of loads, and the second low-voltage power supply circuit being connected with an output side of the power-factor correction circuit and generating low voltages from a rectified power for a power supply to respective parts of the apparatus; and a second board mounting portion on which both the single-use circuit board and the complex-use circuit board are selectively mountable.

According to the embodiment thus constructed, when the single-use circuit board is mounted on the second board mounting portion, the alternating-current input from the external commercial power supply is rectified by the second rectifying circuit and the low voltages for a power supply to respective parts of the apparatus are generated by the single-use low-voltage power supply circuit from this rectified power. Thus, the apparatus can be suitably singly used. Further, when the complex-use circuit board is mounted on the second board mounting portion, the low voltages for a power supply to respective parts of the apparatus are generated by the second low-voltage power supply circuit from the power rectified by the first rectifying circuit only by connecting the complex-use connector and the first connector of the image forming apparatus by wiring. Further, the first low-voltage power supply circuit can utilize the power rectified by the first rectifying circuit only by connecting the power-factor connector and the second connector by wiring. Thus, the image reading apparatus can be suitably used by being connected with the image forming apparatus. Here, since the first rectifying circuit is shared, the number of parts can be reduced, the construction can be simplified and cost can be reduced. Further, although the image forming apparatus and the image reading apparatus are used by being connected with each other, an input current from the external commercial power supply can be prevented from becoming excessive since the power factors of the loads are corrected by the power-factor correction circuit.

Further, the complex machine according to the embodiment, in other words, comprises: an image forming apparatus that forms an electrostatic latent image, forms a toner image by developing the electrostatic latent image with toner, and fixes the toner image onto a transfer sheet; and an image reading apparatus that is used by being connected with the image forming apparatus and reads an image of a document. Further, the image forming apparatus includes: a first rectifying circuit that is connected with an external commercial power supply and rectifies an alternating-current input; a first low-voltage power supply circuit that generates low voltages from a rectified power for a power supply to respective parts of the apparatus; a first connector that is connected with the first rectifying circuit and is for outputting a power rectified by the first rectifying circuit; and a second connector that is connected with the first low-voltage power supply circuit and is for taking in a rectified power. Further, the image reading apparatus includes: a power-factor correction circuit that corrects the power factors of loads; a second low-voltage power supply circuit that is connected with an output side of the power-factor correction circuit and generates low voltages from a rectified power for a power supply to respective parts of the apparatus; a complex-use connector that is connected with an input side of the power-factor correction circuit; and a power-factor connector that is connected with an output side of the power-factor correction circuit. Further, the first connector and the complex-use connector are connected by wiring, and the second connector and the complex-use connector are connected by wiring.

According to the embodiment thus constructed, the alternating-current input from the external commercial power supply is rectified by the first rectifying circuit, the rectified power is supplied to the second low-voltage power supply circuit via the first connector, the complex-use connector and the power-factor correction circuit, and the low voltages for a power supply to respective parts of the apparatus are generated by the second low-voltage power supply circuit. Accordingly, the image reading apparatus can be suitably operated. Further, the alternating-current input from the external commercial power supply is rectified by the first rectifying circuit, this rectified power is supplied to the first low-voltage power supply circuit via the first connector, the complex-use connector, the power-factor correction circuit, the power-factor connector and the second connector, and the low voltages for a power supply to respective parts of the apparatus are generated by the first low-voltage power supply circuit. Accordingly, the image forming apparatus can be suitably operated. Here, since the first rectifying circuit is shared, the number of parts can be reduced, the construction can be simplified and cost can be reduced. Further, since the power factors of the loads are corrected by the power-factor correction circuit, an input current from the external commercial power supply can be prevented from becoming excessive.

Figure 8:
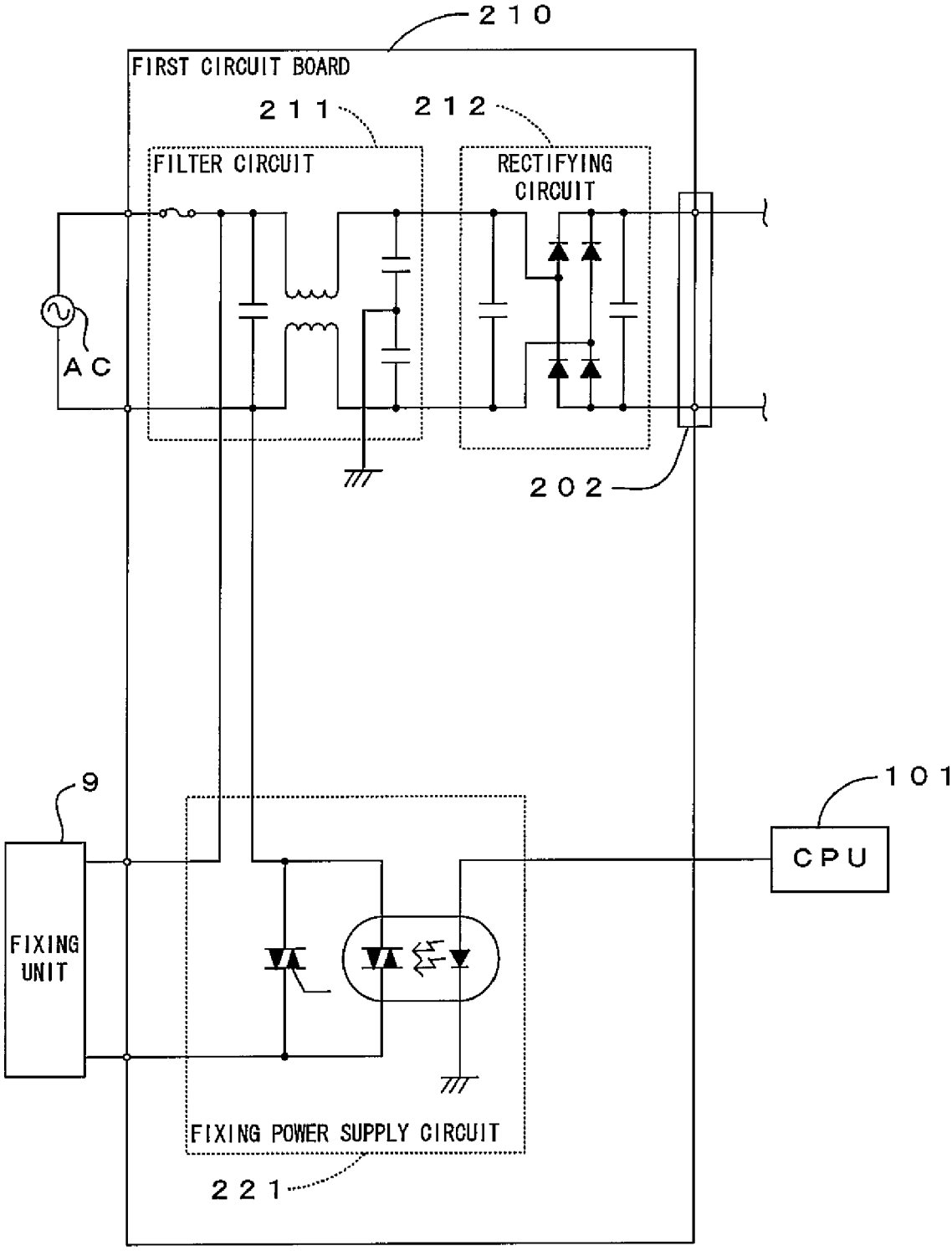
FIG. 8 is a circuit diagram showing a modification of a first circuit board.

It should be appreciated that the invention is not limited to the above embodiment and various changes other than the above can be made without departing from the object of the invention. For example, although the fixing power supply circuit 221 is mounted on the second circuit board 220 as shown in FIGS. 5A and 6A in the above embodiment, the invention is not limited thereto. For example, the fixing power supply circuit 221 may be mounted on the first circuit board 210 as shown in FIG. 8. In this modification as well, functions and effects similar to those of the above embodiment can be obtained.

Further, the scanner 300 may include a facsimile function of external communication via telephone lines in addition to the image reading function.

Further, in the above embodiment, although the invention is applied to the image forming apparatus for transferring a color image to a sheet S after the color image is temporarily formed on an intermediate transfer medium such as the intermediate transfer belt 71, it is also applicable to apparatuses for forming a color image by superimposing toner images directly on a sheet. The apparatus may form monochromatic images without being limited to the one for forming color images.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a first rectifying circuit that is connected with an external commercial power supply and rectifies an alternating-current input;

a first low-voltage power supply circuit that generates low voltages from a rectified power for power supply to respective parts of the image forming apparatus;

a first connector that is connected with the first rectifying circuit and is for outputting a power rectified by the first rectifying circuit; and a second connector that is connected with the first low-voltage power supply circuit and is for taking in a rectified power, wherein the image forming apparatus is singly usable and optionally usable by being connected with an image reading apparatus, the image forming apparatus forms an electrostatic latent image, forms a toner image by developing the electrostatic latent image with toner, and fixes the toner image onto a transfer sheet, the first connector and the second connector are connected by wiring, in a case where the image forming apparatus is singly used, and the first connector and the image reading apparatus are connected by wiring, and the second connector and the image reading apparatus are connected by wiring, in a case where the image forming apparatus is used by being connected with the image reading apparatus.

2. The image forming apparatus according to claim 1, further comprising:

a first circuit board on which the first rectifying circuit is mounted and to which the first connector is attached;

a second circuit board on which the first low-voltage power supply circuit is mounted, to which the second connector is attached, and which is different from the first circuit board; and a first board mounting portion on which the first circuit board and the second circuit board can be mounted.

3. An image reading apparatus, comprising:

a single-use circuit board on which a second rectifying circuit and a single-use low-voltage power supply circuit are mounted, the second rectifying circuit being connected with an external commercial power supply and rectifying an alternating-current input, the single-use low-voltage power supply circuit being connected with the second rectifying circuit and generating low voltages for a power supply to respective parts of the image reading apparatus from a power rectified by the second rectifying circuit;

a complex-use circuit board on which a power-factor correction circuit and a second low-voltage power supply circuit are mounted, and to which a complex-use connector connected with an input side of the power-factor correction circuit and a power-factor connector connected with an output side of the power-factor correction circuit are attached, the power-factor correction circuit for correcting the power factors of loads, and the second low-voltage power supply circuit being connected with an output side of the power-factor correction circuit and generating low voltages from a rectified power for a power supply to respective parts of the image reading apparatus; and a second board mounting portion on which both the single-use circuit board and the complex-use circuit board are selectively mountable, wherein the image reading apparatus is singly usable and optionally usable by being connected with the image forming apparatus according to claim 1, the image reading apparatus reads an image of a document, the single-use circuit board is mounted on the second board mounting portion, in a case where the image reading apparatus is singly used, and the complex-use circuit board is mounted on the second board mounting portion, the first connector of the image forming apparatus according to claim 1 and the complex-use connector are connected by wiring, and the second connector of the image forming apparatus according to claim 1 and the power-factor connector are connected by wiring, in a case where the image reading apparatus is used by being connected with the image forming apparatus according to claim 1.

4. A complex Machine, comprising:

an image forming apparatus that forms an electrostatic latent image, forms a toner image by developing the electrostatic latent image with toner, and fixes the toner image onto a transfer sheet; and an image reading apparatus that is used by being connected with the image forming apparatus and reads an image of a document, wherein the image forming apparatus includes:

a first rectifying circuit that is connected with an external commercial power supply and rectifies an alternating-current input;

a first low-voltage power supply circuit that generates low voltages from a rectified power for a power supply to respective parts of the apparatus;

a first connector that is connected with the first rectifying circuit and is for outputting a power rectified by the first rectifying circuit; and a second connector that is connected with the first low-voltage power supply circuit and is for taking in a rectified power, wherein the image reading apparatus includes:

a power-factor correction circuit that corrects the power factors of loads;

a second low-voltage power supply circuit that is connected with an output side of the power-factor correction circuit and generates low voltages from a rectified power for a power supply to respective parts of the apparatus;

a complex-use connector that is connected with an input side of the power-factor correction circuit; and a power-factor connector that is connected with an output side of the power-factor correction circuit, wherein the first connector and the complex-use connector are connected by wiring, and wherein the second connector and the power-factor connector are connected by wiring.

5. The complex machine according to claim 4, wherein the image forming apparatus includes:

a first circuit board on which the first rectifying circuit is mounted and to which the first connector is attached;

a second circuit board on which the first low-voltage power supply circuit is mounted, to which the second connector is attached, and which is different from the first circuit board; and a first board mounting portion on which the first circuit board and the second circuit board can be mounted.

6. The complex machine according to claim 4, wherein the image reading apparatus further includes a facsimile function of external communication via telephone lines.

* * * * *